United States Patent [19]

Salkeld et al.

[11] 4,448,231

[45] May 15, 1984

[54] PANEL SYSTEM EDGE SEALING MEANS

[75] Inventors: Stephen A. Salkeld, Mechanicsburg; Mark E. Stock, McSherrystown, both of Pa.; Robert J. Welch, West Chicago, Ill.

[73] Assignee: Litton Business Systems, Inc., York, Pa.

[21] Appl. No.: 405,625

[22] Filed: Aug. 5, 1982

Related U.S. Application Data

[63] Continuation of Ser. No. 047,650, Jun. 11, 1979, abandoned.

[51] Int. Cl.[3] ..... A47G 5/00

[52] U.S. Cl. ..... 160/135

[58] Field of Search ..... 160/135, 351; 49/480, 49/481, 488, 489, 496, 486, 482

[56] References Cited

U.S. PATENT DOCUMENTS

| | | | |
|---|---|---|---|
| 1,381,744 | 6/1921 | Riggs | 160/199 |
| 2,135,131 | 11/1938 | Bassett | 49/27 |
| 2,933,784 | 4/1960 | Hooverson | 49/481 |
| 3,110,065 | 11/1963 | Dennis | 49/498 |
| 3,154,303 | 10/1964 | Cavallero et al. | 49/27 |
| 3,226,367 | 12/1965 | Monti | 49/489 |
| 3,537,199 | 11/1970 | Lawson | 160/135 X |
| 3,656,260 | 4/1972 | Weaver | 49/498 |
| 3,827,183 | 8/1974 | Zimmerman | 49/383 |
| 3,971,182 | 7/1976 | Donahue et al. | 160/135 |
| 4,010,573 | 3/1977 | Andrzejewski | 49/498 |

*Primary Examiner*—Peter M. Caun
*Assistant Examiner*—Cherney S. Lieberman
*Attorney, Agent, or Firm*—Michael H. Wallach; Robert F. Rotella

[57] ABSTRACT

A panel having edge sealing means comprising an outer, soft and yieldable arcuate portion; and an inner relatively rigid portion by which the sealing means is mounted to the panel and which also provides structural rigidity for the panel edge.

1 Claim, 7 Drawing Figures

PANEL SYSTEM EDGE SEALING MEANS

This is a continuation, of application Ser. No. 47,650 filed June 11, 1979 now abandoned.

BACKGROUND OF THE INVENTION

1. Field of the Invention

This invention relates to panel or room divider systems and more particularly to a novel edge sealing means for the panels of such a system.

2. Description of the Prior Art

Prior art panels have been provided with edge sealing means as shown in U.S. Pat. Nos. 3,766,692; 3,971,182, 4,031,675; and 4,104,838.

SUMMARY OF THE INVENTION

In accordance with the present invention, there is provided a novel edge sealing means for the panels of a panel system. In a preferred form of the invention, the sealing means comprises a first, outer, relatively yieldable elastomeric portion and a second, relatively rigid portion, the latter being adapted to be mounted to the panel and also providing structural rigidity for the panel edge. The yieldable portion of the seal is arcuate in cross section and of sufficient arcuate length, e.g., substantially semi-circular, so that there will be formed an effective seal even when two abutting panels are disposed at 90° to one another.

It is therefore a primary object of the invention to provide improved edge sealing means for panels.

It is a further object to provide such a sealing means which includes a flexible, outer sealing portion, and an inner rigid portion whereby the seal can be readily mounted to a panel.

It is a further object to provide a panel sealing means which also includes a rigid portion for increasing the structural rigidity of the panel.

It is a further object to provide a novel panel sealing means which provide an effective seal between panels which are disposed at various angles, including a right angle, to one another.

The above and other objects, advantages, and features of the invention will become apparent to those of ordinary skill in the art from the following detailed description of a specific embodiment of the invention when read in conjunction with the accompanying drawings, in which:

DETAILED DESCRIPTION OF A SPECIFIC EMBODIMENT

Figure 1:
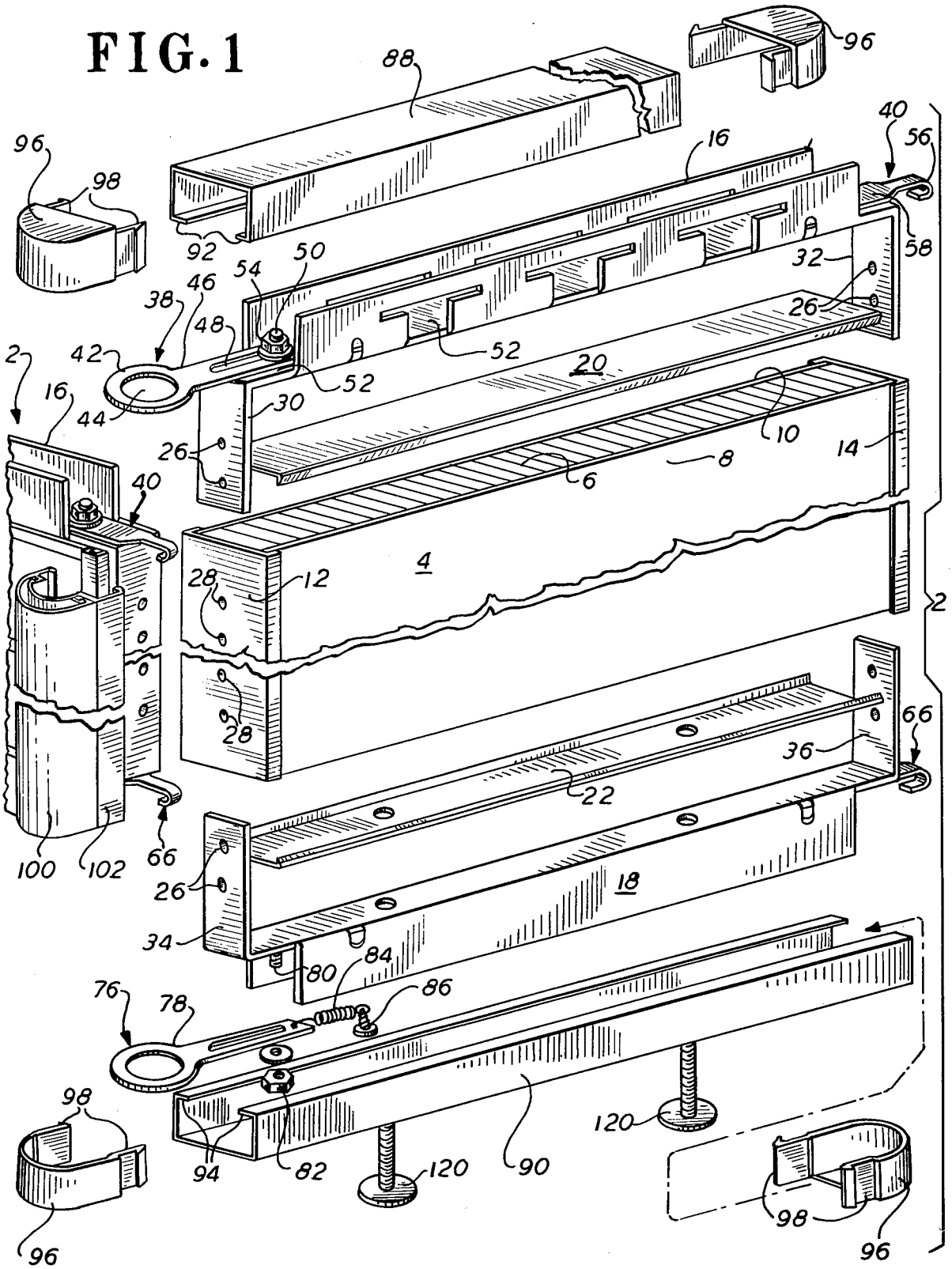
FIG. 1 is an exploded perspective view showing one panel and a portion of an adjacent panel.

In the drawings, and noting especially FIG. 1, the reference numeral 2 denotes a panel in its entirety. Each panel in the present system is identical in construction to all the other panels of the system, and is so constructed as to be readily interconnected with one or more like panels to form a panel system of any desired configuration. Each panel 2 comprises a main body portion 4 (see also FIG. 6), comprising a conventional honeycomb core 6 disposed between outermost front and back boards 8, 10, e.g., of hard stiff cardboard, to each of whose outermost vertical surfaces may be secured a layer of fabric. Panel 2 includes along its opposed vertical edges metal channels 12 and 14 mounted over the main body portion 4; and along its top and bottom edges respective upper and lower horizontally extending channels with 16, 18. Channel 16 opens upwardly and channel 18 downwardly. A decorative downwardly opening channel reveal strip 20 mounted over the top of the panel main body portion 4 lies between the latter and the upper horizontal channel 16. A like upwardly opening decorative channel reveal strip 22 is provided at the bottom of the panel body 4 between it and the lower horizontal channel 18.

Figure 2:
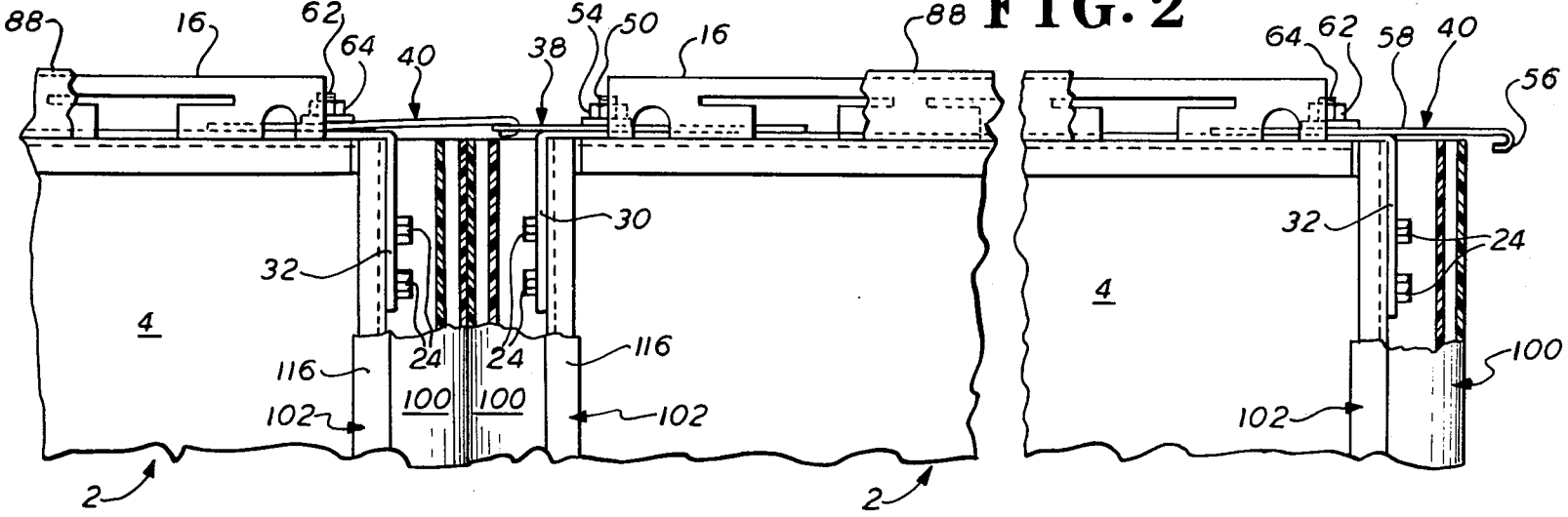
FIG. 2 is a fragmentary front elevational view, partially in section, showing two interconnected panels.
Figure 3:
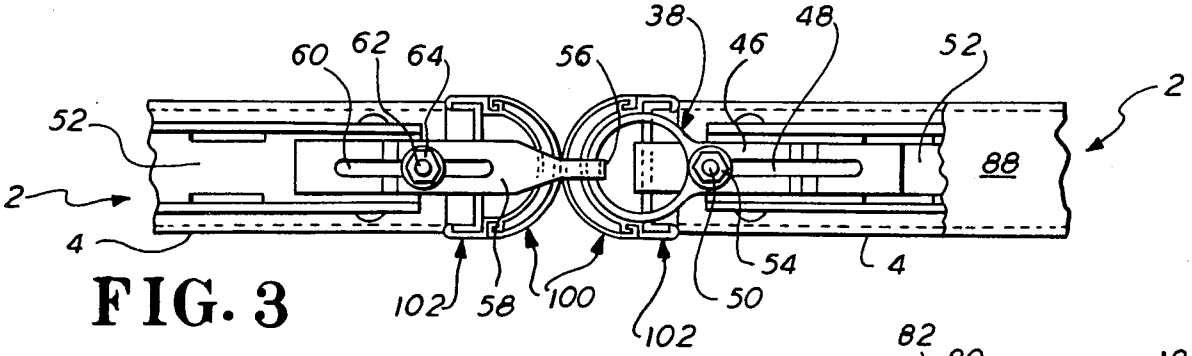
FIG. 3 is a top plan view of FIG. 2.

At the four corners of the panel 2, the adjacent ends of vertical side channels 12, 14, and horizontal channels 16, 18 are rigidly secured together by sheet metal screws 24 (FIG. 2). The latter are screwed through aligned holes 26, 28 provided respectively in vertically extending offset lugs 30, 32 and 34, 36 provided at the opposite ends of the upper and lower horizontal channels 16, 18.

The means whereby each panel is interconnected to other like panels will now be described. Such means basically comprises a substantially flat, horizontally longitudinally adjustable ring member 38 provided at one end, i.e., side, of the panel and a substantially flat, horizontally longitudinally adjustable hook member 40 provided at the panel's opposite end. The hook member is adapted to interengage, i.e., be hooked over, the ring of an adjacent one or more panels; and the ring member is adapted to be interengaged in coupled relationship by the hook members of one or more adjacent panels. The ring member 38 is substantially flat and may be stamped from flat metal stock. At its leftmost end, it has a flat ring portion comprising a flat annulus 42 surrounding a central through hole 44. The remaining portion of the ring member comprises a longitudinally extending elongated mounting plate 46 provided with an elongated slot 48. Ring member 38 is mounted on upper channel 16 by means of a threaded stud 50 rigid with the channel and extending upwardly from its base wall 52. Stud 50 extends upwardly through slot 48, a nut 54 threaded on stud 50 serving to hold the ring member 38 securely but releasably against the channel base 52. The nut can be loosened, the ring member shifted to any desired longitudinally adjusted position relative to the length of the panel, and the nut then retightened. The front to back width of plate portion 46 is somewhat less, about ⅛" on each side, than the inner width of channel 16. Hence, in addition to being adjustable longitudinally ring member 38 also has sufficient clearance for a limited amount of horizontal rotary adjustment movement about stud 50 as an axis.

At the other end of upper channel 16 there is provided the hook member 40 of the interconnecting means. Like ring member 38, hook member 40 is formed of a flat sheet metal stock. At its outer end it is bent downwardly and reentrantly to form a hook portion 56. The remaining inner portion of the hook member comprises a longitudinally extending mounting plate portion 58. As in ring member 38, plate portion 58 is provided with a slot 60 whereby it is mounted on an upstanding threaded stud 62 rigid with the base wall 52 of channel 16; and can be secured in any desired longitudinal position, as limited by the length of slot 60, by means of a threaded nut 64 mounted on stud 62.

At its bottom, panel 2 is provided with a lower hook member 66 identical in construction with the upper hook member. Lower hook member 66 is mounted by means of its longitudinally extending slot 68 on threaded stud 70 rigid with and depending from the base wall 72 of lower channel 18. Threaded nut 74 holds hook member 66 on stud 70.

Figure 4:
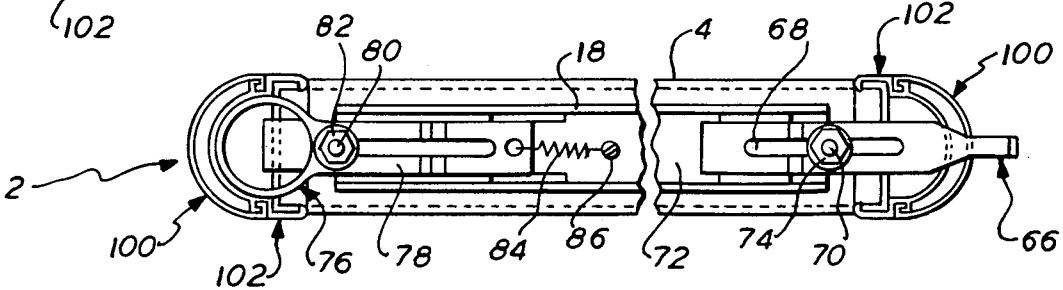
FIG. 4 is a bottom plan view of the right hand panel of FIG. 2.

Panel 2 is provided at the other end of its bottom portion with a lower ring member 76 substantially identical in construction and manner of mounting with the upper ring member 38. The lower ring member is mounted by its slotted mounting plate 78 on a threaded stud 80 rigid with and depending from the lower channel base wall 72. A nut 82 threaded on stud 80 holds ring member 76 in position, the nut being tightened sufficiently but not to its fullest possible extent, so that the ring member is free to slide back and forth in face-to-face contact with the under side of the base wall 72 of channel 18. A heavy tension spring 84 is connected at its inner end to channel base wall 72 by a sheet metal screw 86 and at its other end to the inner end of ring member 76. Spring 84 exerts a substantial pulling bias on the ring member, normally pulling it inwardly, i.e., to the right in FIGS. 1 and 4, as limited by the leftmost end wall of the ring member's mounting slot engaging stud 80.

To connect the panels 2 of the present system together, they are placed adjacent to each other with the ring member side of one panel closely adjacent to the hook connector side of another panel. The lower ring member 76 is then pulled outwardly against the bias of spring 84 and the lower hook member 66 of the adjacent panel hooked over the ring annulus. The relatively heavy tension of the spring will pull the panels towards each other and hold them together. (If desired, nut 82 may now be fully tightened to lock ring member 76 in place.) The adjacent upper hook and ring members 40, 38 of the two panels are released for longitudinal movement by loosening their respective holding nuts 64, 54, the upper portions of the panels are pushed tightly against each other, and the hook hooked over the ring. Then, the two upper nuts are tightened to secure the now interengaged upper hook and ring members tightly together.

As will be described shortly, the panels 2 are provided along substantially their entire vertical outer edges with a yieldable portion so that when the panels are pulled each against each other, there is formed a light and sound seal.

As described earlier in connection with upper ring member 42, all the upper and lower ring and hook members are somewhat narrower in width than the inner width of the respective channels in which they are mounted, there being about a $\frac{1}{8}$" clearance on each side of the mounting plate. This allows various ring and hook member connectors, in addition to being longitudinally shiftable for panel interconnection, to also be free for a limited amount of rotary movement about their mounting studs. This provides greater flexibility in interconnecting the panels which are not in alignment.

Figure 6:
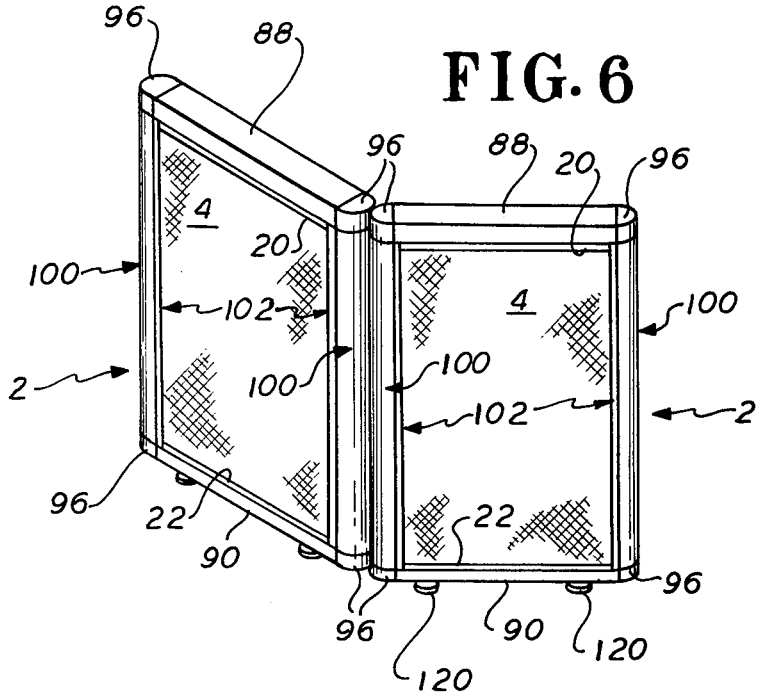
FIG. 6 is a perspective view showing two interconnected panels.
Figure 7:
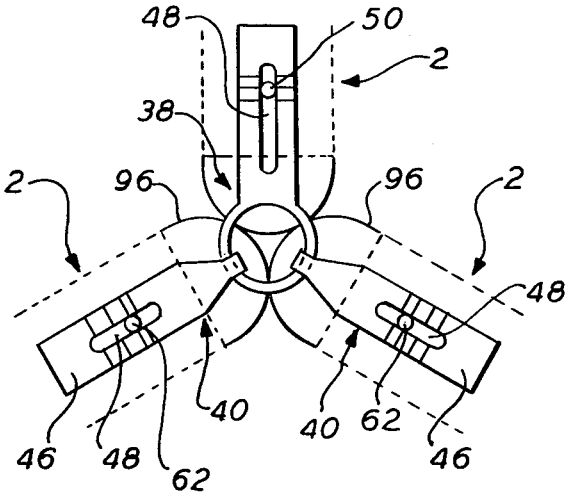
FIG. 7 is an essentially schematic top plan view showing three panels interconnected at one point in radial fashion.

The panels may be interconnected in any desired arrangements, for example, end to end in any desired number; or more than two panels may be interconnected at one point in radial fashion. FIGS. 6 and 7 show such panel arrangements. It will be understood that many other types of interconnected panel arrangements can be employed.

Top and bottom covers 88 and 90 (FIGS. 1, 6) are provided for the respective upper and lower channels 16 and 18. Covers 88 and 90 are identical in shape and may comprise relatively stiff but resiliently flexible plastic channelshaped members which can be snapped or slid over the corresponding channel member. Inwardly extending flanges 92 and 94 of the covers hold them in place by extending under the inwardly turned bottoms of the channel side walls. Plastic end caps 96 seal the open opposite ends of covers 88, 90. The end caps are mounted on the covers by inserting integral arms 98 of the caps within the cover, the arms resiliently pressing outwardly to engage the inside faces of the cover side walls.

The vertical side edge sealing means of the panels 2 will now be described. The sealing means comprises an outermost, quite yieldable, soft, elastomeric member 100 having a substantially semicircular cross section, and an inner substantially hard and rigid member 102. Outer yieldable member 100 includes an outermost semicircular body portion 104 which terminates at its ends in inwardly directed reentrant flange members 106. The inner rigid member 102 likewise has a main arcuate substantially semicircular outermost portion 108. At the inner ends of the latter there are provided short laterally directed rib members 110 which at their outer ends join with transversely directed portions 112. Further inwardly of rib members 110 the inner rigid member 102 is formed with slightly longer lateral rib members 114 whose free ends join integral transversely extending wall portions 116 terminating at their innermost ends in short inwardly directed retainer flanges 118.

Figure 5:
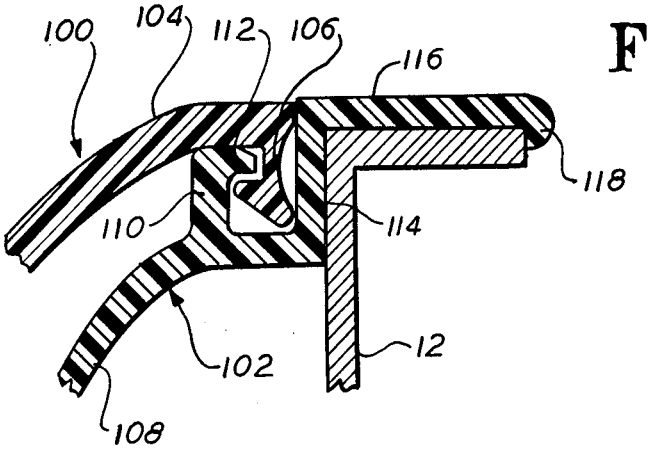
FIG. 5 is an enlarged fragmentary transverse sectional plan view of the panel side sealing means.

The respective flange and rib portions 106 and 110, 112 of seal members 110 and 102 provide complementary interengaging locking means whereby the seal members may be secured together. To assemble them, seal members 100 and 102 are placed in end to end relationship aligned in the position shown in FIG. 5. The outer member 100 is slid down over the rigid member 102 with the interlocking aforedescribed flange and rib portions 106 and 110, 112 engaged in coupled relations as shown. The reentrant rib, wall, and flange portions 114, 116, 118 of the inner rigid sealing member 102 serve as means whereby the latter is mounted to the wall panel. For this purpose, the inner sealing member 102 although relatively rigid is of sufficiently thin wall construction that the opposed confronting portions 116 thereof can be flexed away from each other and mounted over the side walls of the vertical channel, e.g., channel 12 of FIG. 5.

In the final assembled position of the parts, the reentrant endmost retainer flanges 118 of inner sealing member 102 have snapped over the innermost vertical side edges of the side walls of channel 12 so that sealing member 102 is securely held to the panel. To remove sealing member 102 the above process is reversed, i.e., its wall portions 116 are flexed away from each other to free it from channel 12 for removal.

Preferably the flexible and rigid members 100, 102 making up the side sealing means are secured together after being assembled, as by stapling or gluing.

The sealing means as described above are of course provided along both side edges of each panel 2.

In use, when the side edges of two or more panels are abutted, the mutually abutting arcuate outer seal members 100 thereof will readily compress or yield against one another to form an effective light and sound seal. The extent of such yielding will of course be determined by how tightly the panels are pulled together.

The rigidity of the inner members 102 of the sealing means is advantageous for a number of reasons. It permits the sealing means to be readily mounted on the panel, which would be considerably more difficult to do if an entirely substantially yieldable member were used. It also aids in providing structural stiffness to the side edges of the panel. This stiffness is further augmented by the convex arcuate cross section of portion 108 inner seal member 102. The convexity of this seal member is further desirable in that it provides additional clearance space for any desired underlying structure of the panel. The yieldable outer seal members 100 also provide a safety cushion for the outer edges of panels 2.

The two seal members 100 and 102 of the sealing means can be made of any suitable material. Preferably they are of a synthetic resinous material, such as polyvinyl chloride, having the aforedescribed different hardness and flexibility characteristics, i.e., member 100 being quite soft and yieldable whereas member 102 is relatively hard and rigid.

Because of the convex, substantially semicircular cross section of the outermost seal members 100, the seal members of adjacent abutting panels will effectively engage each other in sealed relationship even though the panels are in various obtuse angular positions relative to one another, such as the approximately 120° relationship shown in FIG. 7, and even when the panels are arranged in a 90° relationship as would be the case if the two lowermost panels shown in FIG. 7 were disposed at right angles to the central panel shown there. In this regard, it should be noted that the seal members 100 extend sufficiently far out to the side of, i.e., in the direction of the length of, each panel so that they can sealingly engage an adjacent interconnected panel. In other words, seal members 100 are of sufficient horizontal longitudinal extent relative to panel 2 and the interengagable portions of the hook and ring connectors 40, 42 so that when the hook and ring connectors of adjacent panels are intercoupled as in FIG. 7, the cooperating seal members 100 of the adjacent panels 2 effectively engage one another.

Although the sealing means has been disclosed and described as being two separate members 100, 102 of different hardness and yieldability, if desired it could be made of one member, e.g., a single integral polyvinyl chloride member, differentially treated so that its outermost portion is elastomeric and relatively flexible, whereas its inner portion has the desired hardness and rigidity.

Conventional levelers 120 are provided at the bottom of each panel 2.

While there has been described and shown in the foregoing specification and drawing a specific embodiment of the invention, it will be appreciated that the various principles and features of the invention are susceptible of numerous modifications and applications. Accordingly, it should be understood that the foregoing disclosure of a specific embodiment of the invention is intended to be illustrative and exemplary only.

We claim:

1. In a room divider panel system comprised of two or more panels, each of said panels having a vertical edge, spring-biased means connected between said panel, said spring-biased means permitting two or more of said panels to be drawn against each other along said panels' vertical edges in any of a plurality of angular positions relative to each other, an improved means for sealing the vertical edges of adjoining panels so that said vertical edges are sealed along their length when two or more of said panels are joined in any of a plurality of angular positons, an identical one of said edge sealing means being mounted along each vertical adjoining edge of each of said adjoining panels, each of said adjoining edge sealing means being comprised of a first, outer, relatively yieldable substantially semi-circular elastometric sealing portion and a second, inner, relatively rigid portion, said first portion being substantially concentric in configuration with said second portion, said second portion being convexly arcuate in cross section, whereby said spring-biased means draws each of said first elastometric substantially semi-circular sealing portions of adjoining edge sealing means into contact with each other to produce an intimate sealing relationship along the vertical edges of adjoining panels when said panels are in a plurality of angular positions relative to each other.

* * * * *

UNITED STATES PATENT AND TRADEMARK OFFICE

CERTIFICATE OF CORRECTION

PATENT NO. : 4,448,231

DATED : May 15, 1984

INVENTOR(S) : Stephen A. Salkeld, Mark E. Stock, Robert J. Welch

It is certified that error appears in the above—identified patent and that said Letters Patent is hereby corrected as shown below:

In the Detailed Description of a Specific Embodiment

In Col. 4, line 44, delete "110" and substitute therefor the number --100--.

In Col. 5, line 12, delete "members" and substitute therefor the word --member--.

Signed and Sealed this

Second Day of October 1984

[SEAL]

*Attest:*

GERALD J. MOSSINGHOFF

*Attesting Officer*

*Commissioner of Patents and Trademarks*